US006095194A

United States Patent [19]

Minato et al.

[11] Patent Number: 6,095,194

[45] Date of Patent: Aug. 1, 2000

[54] PULSATION SUPPRESSION DEVICE FOR A PUMP

[75] Inventors: Yoji Minato; Masayoshi Katsura; Makoto Fujii, all of Sanda, Japan

[73] Assignee: Nippon Pillar Packaging Co., Ltd., Osaka, Japan

[21] Appl. No.: 09/265,355

[22] Filed: Mar. 10, 1999

[30] Foreign Application Priority Data

Mar. 20, 1998 [JP] Japan ..... 10-072321
Mar. 20, 1998 [JP] Japan ..... 10-072322

[51] Int. Cl.[7] ..... F16L 55/04

[52] U.S. Cl. ..... 138/31; 138/26; 73/239

[58] Field of Search ..... 138/30, 31, 26; 73/239

[56] References Cited

U.S. PATENT DOCUMENTS

| | | | |
|---|---|---|---|
| 2,828,760 | 4/1958 | Taylor et al. | 138/31 X |
| 3,336,948 | 8/1967 | Lucien | 138/31 |
| 3,351,097 | 11/1967 | Moran | 138/31 X |
| 3,454,050 | 7/1969 | Wolf | 138/31 |
| 4,644,976 | 2/1987 | Peter et al. | 138/31 |
| 4,646,782 | 3/1987 | Ezekoye | 138/31 X |
| 4,691,739 | 9/1987 | Gooden | 138/31 |
| 4,799,048 | 1/1989 | Goshima et al. | 138/31 X |

*Primary Examiner*—Patrick Brinson
*Attorney, Agent, or Firm*—Jones, Tullar & Cooper, P.C.

[57] ABSTRACT

The present invention relates to a pulsation suppression device which is interposingly used in a liquid transporting pipe through which a chemical liquid such as a surface washing liquid for washing an IC is transported by a reciprocal pump. The pulsation suppression device of the present invention has: a bellows which partitions the interior of the device body having a sealed container-like shape, into a liquid chamber and an gas chamber; an operating rod which is reciprocated in interlock relationship with the bellows; and an extension and contraction restricting mechanism which, when the bellows extends to a predetermined value, is contacted in parallel with a closed end face of the bellows, thereby restricting further extension of the bellows. Furthermore, the pulsation suppression device of the present invention has a guide for making the reciprocal operation of the operating rod coincident with the extension and contraction directions of the bellows. The guide is made of a low-friction resin material. According to the present invention, pulsation due to the discharge pressure of the transported liquid is absorbed and the amplitude of pulsation is suppressed to a low level. Moreover, the bellows used in the pulsation suppression device is prevented from being damaged, and the pulsation suppression function can be stabilized.

12 Claims, 7 Drawing Sheets

PULSATION SUPPRESSION DEVICE FOR A PUMP

BACKGROUND OF THE INVENTION

1. Field of the Invention

The present invention relates to a pulsation suppression device for a pump. A pulsation suppression device of this type is used for suppressing pulsation (pulsative pressure) of a discharge pressure which is produced by variation in the flow rate or the pressure when a reciprocal pump is operated. Therefore, the pulsation suppression device of the present invention may be interposingly used in a liquid transporting pipe through which various processing chemical liquids such as a washing liquid used in a semiconductor production step, specifically, a surface washing liquid for washing an IC or a liquid crystal device is transported by a reciprocal pump.

2. Description of the Prior Art

As a pulsation suppression device for a pump of this type, a device having a configuration which is disclosed in, for example, Japanese Patent Publication Laying-Open No. 8-159016 is known. The proposed pulsation suppression device has a liquid chamber and a gas chamber which are separated from each other by an extendable and contractible barrier such as a bellows or a diaphragm. In the pulsation suppression device, the liquid chamber has a role of temporarily storing the liquid (such as the chemical liquid) to be transported by a reciprocal pump, and the gas chamber has a role of being filled with a gas for suppressing pulsation. The capacity of the liquid chamber is changed by means of extension and contraction of the diaphragm so as to maintain the pressure balance between the liquid chamber and the gas chamber, thereby suppressing pulsation of the discharge pressure of the reciprocal pump.

The pulsation suppression device further has a gas supply and discharge switching valve mechanism. The switching valve mechanism is provided with a function of, in accordance with a change in the capacity of the liquid chamber, being alternately switched to a normal mode in which the gas is not supplied to nor discharged from the gas chamber, a gas supply mode in which the gas is supplied to the gas chamber, and a gas discharge mode in which the gas is discharged from the gas chamber. These modes are switched over by means of a reciprocal operation of an operating rod interlocked with extension and contraction of the diaphragm.

According to the known pulsation suppression device pulsation of the transported liquid due to the discharge pressure of the pump can be suppressed by means of a change in the capacity of the liquid chamber which is caused by extension and contraction of the diaphragm, and also the change in the capacity of the liquid chamber can be suppressed to a low degree by the gas chamber pressure adjusting function of the gas supply and discharge switching valve mechanism.

All conventionally used pulsation suppression devices has the following problem. In an example case where such a pulsation suppression device is accidentally operated under a condition where the gas is not supplied to the gas chamber, when the pressure of the transported liquid is abnormally raised, the pressure balance between the liquid chamber and the gas chamber is broken and the diaphragm abnormally extends. A closed end face of the thus extending diaphragm strongly collides with an end portion of the operating rod which is a part disposed in the gas chamber. This collision may cause the closed end face of the diaphragm to be deformed or damaged. In some cases, an excessive force may be applied also to the operating rod, so that the operating rod is deformed or broken. When such a situation occurs, there arises a fear that the subsequent operation will be hindered and the expected pulsation suppression function cannot be exerted. Depending on the degree of the damage of the closed end face of the diaphragm, furthermore, a serious situation where the transported liquid such as a chemical liquid leaks to the outside may occur.

In order to enhance the pulsation suppression function of a pulsation suppression device of this type, it is effective to increase the internal capacity of the gas chamber. When the gas chamber is elongated in the extension and contraction directions of the diaphragm in order to increase the internal capacity of the gas chamber, however, the axial length of the operating rod which is reciprocally operated in the extension and contraction directions of the diaphragm in interlock relationship with extension and contraction of the diaphragm must be increased. When the operating rod is elongated in this way, the operating rod is easily inclined, or a spring which is used for urging the diaphragm in the contraction direction is hardly maintained to a suitable shape. This causes a fear that the operation direction of the operating rod fails to coincide with the extension and contraction directions of the diaphragm. When such a situation occurs, the reliability of the operation of the gas supply and discharge switching valve mechanism is lowered, or the operation itself is not adequately conducted, thereby causing a fear that the expected gas supplying and discharging action of the gas chamber cannot be correctly performed.

SUMMARY OF THE INVENTION

It is an object of the present invention to provide a pulsation suppression device for a pump in which a pulsation suppression function can be enhanced.

It is another object of the present invention to provide a pulsation suppression device for a pump in which the present extension of a diaphragm can be suppressed to a safety range where the diaphragm is not deformed nor damaged.

It is a further object of the present invention to provide a pulsation suppression device for a pump in which a serious situation such as leakage of a transported liquid to the outside can be prevented from occurring.

It is a still further object of the present invention to provide a pulsation suppression device for a pump in which the reliability of the operation of a gas supply and discharge switching valve mechanism can be enhanced.

It is a still further object of the present invention to provide a pulsation suppression device for a pump in which the above-mentioned objects can be attained only by adding a simple configuration.

In the pulsation suppression device for a pump according to the present invention, the presumption portion has a configuration comprising: a device body having a sealed container-like shape; a diaphragm which partitions an interior of the device body into a liquid chamber that can temporarily store a liquid to be transported by a reciprocal pump, and a gas chamber that is to be filled with a gas for suppressing pulsation, and which extends and contracts to change a capacity of the liquid. chamber, thereby absorbing pulsation due to a discharge pressure of the transported liquid; a gas supply and discharge switching valve mechanism which is attached to an outside of the device body, and which, in accordance with a change in the capacity of the liquid chamber, is alternately switched to a normal mode in which the gas is not supplied to nor discharged from the gas chamber, a gas supply mode in which the gas is supplied to the gas chamber, and a gas discharge mode in which the gas is discharged from the gas chamber; and an operating rod which is reciprocated in interlock relationship with extension and contraction of the diaphragm, and which switches over the modes of the switching valve mechanism by means of the reciprocal operation. A discharge pressure curve which shows variation of the discharge pressure of the reciprocal pump that is used when attached to the pulsation suppression device of the present invention forms a waveform in which a peak and a valley are alternatingly repeated as the time elapses.

According to the pulsation suppression device of the present invention having the above-mentioned configuration of the presumption portion, when the transported liquid discharged from the reciprocal pump flows out through the liquid chamber in the device body, the diaphragm extends in a peak portion of the discharge pressure curve, so as to increase the capacity of the liquid chamber, thereby absorbing a pressure rise and contracts in a valley portion of the discharge pressure curve, so as to decrease the capacity of the liquid chamber, thereby absorbing a pressure drop pressure.

According to the pulsation suppression device, when, during the operation of the pulsation suppression device, variation range of the discharge pressure of the reciprocal pump is within a predetermined range, the gas supply and discharge switching valve mechanism is maintained in the normal mode by the action of the operating rod which is reciprocally operated in interlock relationship with extension and contraction of the diaphragm, and hence the gas is not supplied to nor discharged from the gas chamber. In this way, during a period when the gas supply and discharge switching valve mechanism is maintained in the normal mode, the capacity change of the liquid chamber due to extension and contraction of the diaphragm is suppressed to a low degree, and also pulsation of the transported liquid flowing out from the liquid chamber is suppressed to a low degree.

By contrast, when the variation range of the discharge pressure of the reciprocal pump is increased to exceed the predetermined range, the gas supply and discharge switching valve mechanism is switched to the gas supply mode by the action of the operating rod interlocked with extension of the diaphragm, and the gas is supplied to the gas chamber. As a result of the gas supply, the internal pressure of the gas chamber is raised so that extension of the diaphragm is suppressed. On the contrary, when the variation range of the discharge pressure of the reciprocal pump is decreased to exceed the predetermined range, the gas supply and discharge switching valve mechanism is switched to the gas discharge mode by the action of the operating rod interlocked with contraction of the diaphragm, and the gas is discharged from the gas chamber. As a result of the gas discharge, the internal pressure of the gas chamber is lowered so that contraction of the diaphragm is suppressed. Even when the variation range of the discharge pressure of the reciprocal pump is increased or decreased to exceed the predetermined range, therefore, the capacity change of the liquid chamber due to extension or contraction of the diaphragm is suppressed to a low degree, and also pulsation of the transported liquid flowing out from the liquid chamber is suppressed to a low degree.

In the present invention, the characterizing portion has a configuration comprising an extension and contraction restricting mechanism which is disposed in the gas chamber, and which is contacted with a closed end face of the diaphragm that extends to a predetermined value, thereby restricting further extension of the diaphragm.

According to the pulsation suppression device for a pump of the present invention, in an example case where the pulsation suppression device is accidentally operated under a condition where the gas is not supplied to the gas chamber, when the diaphragm extends by the pressure rise of the transported liquid, the extension and contraction restricting mechanism is contacted with the closed end face of the diaphragm, thereby preventing the diaphragm from abnormally extending. Therefore, deformation and a damage of the diaphragm, and those of the stem-like operating rod which are due to the abutment between the diaphragm and the end portion of the operating rod are prevented from occurring. Furthermore, a situation such as that where the closed end face of the abnormally extending diaphragm strongly collides with an end portion of the operating rod which is a part disposed in the gas chamber and this collision causes the closed end face of the diaphragm to be deformed or damaged, or an excessive force is applied also to the operating rod and the operating rod is deformed or broken, or a serious situation such as that where the closed end face of the diaphragm is damaged and the transported liquid leaks to the outside is prevented from occurring.

Preferably, the extension and contraction restricting mechanism has a cylindrical end face which is contacted in parallel with the closed end face of the diaphragm. According to this configuration, also when the closed end face of the diaphragm abuts against the extension and contraction restricting mechanism formed by the cylindrical end face, the gas supplying and discharging action and the pulsation suppression function are appropriately exerted.

Preferably, the extension and contraction restricting mechanism is a mechanism formed by plural cylindrical end faces which are configured by end faces of plural cylindrical bodies that are concentrically arranged in the gas chamber, or a mechanism formed by a single annular plate which is fixedly disposed in the gas chamber. In this case, the length of each of the cylindrical bodies, or the position of the annular plate is preferably set to a position where the diaphragm can be prevented from abnormally extending, and is required to be set so that the extension amount is restricted to a safety value at which no destruction occurs. Preferably, the plural cylindrical bodies and the annular plate have a flow hole having a size which does not impede a flow of the gas. In this case, the flow hole is preferably formed by a notch, a hole, or the like having a size which does not impair the strength of the cylindrical bodies or the annular plate. According to this configuration, although the extension and contraction restricting mechanism is disposed in the gas chamber, the pressure of the gas chamber can be maintained uniform over the whole range, and the diaphragm can extend and contract without distortion.

In the case where the device body is configured as a horizontal type in which the diaphragm extends and contracts in a horizontal direction, a liquid leakage detection sensor may be disposed in a position of a bottom portion of the gas chamber. According to this configuration, even when the liquid is caused by damage of the diaphragm or the like to leak into the gas chamber, the liquid leakage is detected as soon as possible by the liquid leakage detection sensor, so that the leakage can be prevented from developing into a serious situation such as a leakage to the outside of the device body.

In the pulsation suppression device for a pump according to another aspect of the present invention, the presumption portion has the same configuration as that of the pulsation suppression device for the pump described above. Therefore, a discharge pressure curve which shows variation of a discharge pressure of the reciprocal pump that is used while being attached to the pulsation suppression device of the present invention forms a waveform in which a peak and a valley are alternatingly repeated as the time elapses. Furthermore, the presumption portion exerts the same functions as those which are exerted by the presumption portion of the pulsation suppression device for a pump described above, i.e., the function that a pressure drop is absorbed by a peak portion of the discharge pressure curve where the transported liquid discharged from the reciprocal pump flows out through the liquid chamber of the device body, the function that, irrespective of whether the variation range of the discharge pressure of the reciprocal pump is within the predetermined range or not, pulsation of the transported liquid flowing out from the liquid chamber is suppressed to a low degree by the mode switching of the gas supply and discharge switching valve mechanism, and the like functions.

The characterizing portion of the pulsation suppression device according to the other aspect of the present invention is configured so as to, in addition to the above-mentioned configuration of the presumption portion, have a guide which allows the operating rod to slide and which guides the reciprocal operation of the operating rod in the extension and contraction directions of the diaphragm.

According to this configuration, even when the internal capacity of the gas chamber is increased in order to enhance the pulsation suppression function and this causes the axial length of the operating rod to be prolonged, the guide guides the reciprocal operation of the operating rod in the extension and contraction directions of the diaphragm, and hence the operating rod is prevented from being inclined. Therefore, reduction of the operation reliability of the switching valve mechanism for gas supply which is due to the inclination of the operating rod does not occur, and a predetermined gas supplying and discharging action on the gas chamber is conducted correctly and stably.

In the thus configured pulsation suppression device for a pump, preferably, a configuration is employed in which the guide is formed in a projection end portion of a cylindrical member which is protrudingly disposed in the gas chamber, and a flow hole having a size that does not impede a flow of the gas is formed in the cylindrical member. The above-mentioned configuration in which the guide is formed in the projection end portion of the circular cylindrical member is employed because of the following reason. As compared with a case where the guide is formed in a projection end portion of a polygonal cylindrical member, the capacity to be occupied in the gas chamber is decreased so that the assembled device can be easily reduced in size. At the same time, the gas supplying and discharging action on the gas chamber can be smoothly conducted without causing hindrance.

Preferably, the pulsation suppression device for a pump according to the present invention has a spring which pressingly urges the diaphragm in a direction along which the capacity of the liquid chamber is reduced. This spring serves to enable contraction of the diaphragm to be smoothly conducted. Even when this spring is disposed, the guide guides the reciprocal operation of the operating rod in the extension and contraction directions of the diaphragm so as to prevent the operating rod from being inclined, and hence also deformation of the spring is prevented from occurring. Therefore, reduction of the operation reliability of the switching valve mechanism for gas supply which is due to deformation of the spring does not occur, and a predetermined gas supplying and discharging action on the gas chamber is conducted correctly and stably.

Preferably, the guide has a flat seat which holds one end of the spring. According to this configuration, the axial length of the spring can be shortened as far as possible. Consequently, this serves to prevent the spring from being deformed, thereby enabling a predetermined gas supplying and discharging action to be conducted correctly and stably.

The guide may be made of a material which is selected from the group consisting of PP (polypropylene), PVC (polyvinylchloride), PE (polyethylene), POM (polyacetal), PA (polamide), PC (polycarbonate), PTFE (polytetrafluoroethylen plastics), ETFE (ethylene tetrafluoroethylene copolymer), PVDF (poly(vinylidene fluoride) plastics), and PFA (tetrafluoroethylene perfluoroalkoxy vinyl ether copolymer). When the guide is configured by such a material belonging to a low-friction resin material, the friction resistance in the reciprocal operation of the operating rod is reduced, so that the mode switching operation of the gas supply and discharge switching valve mechanism is stabilized.

DETAILED DESCRIPTION OF THE PREFERRED EMBODIMENT

Figure 1:
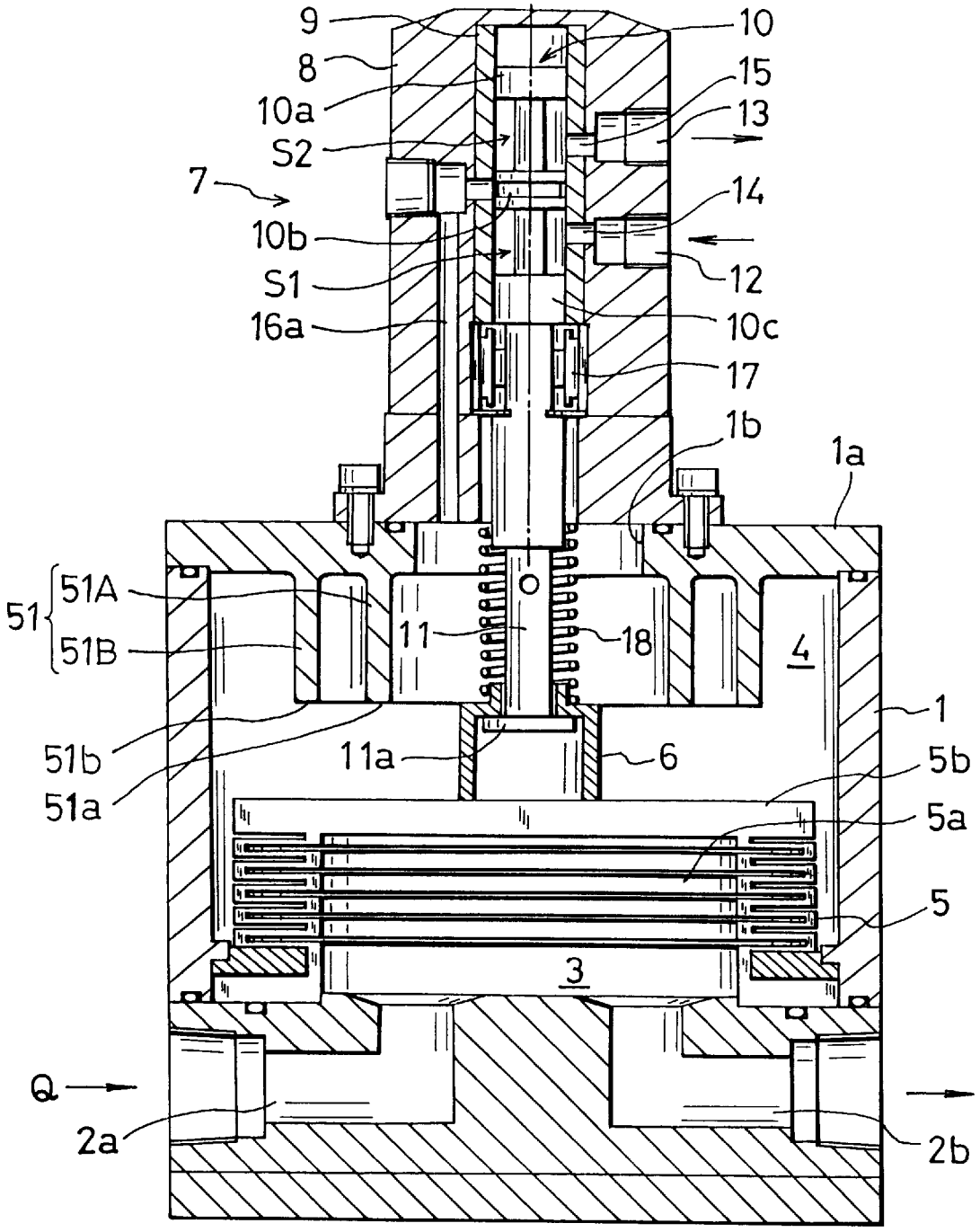
FIG. 1 is a longitudinal sectional front view of an assembly pulsation suppression device for a pump according to one the embodiment of the present invention.

FIG. 1 shows a pulsation suppression device for a pump which is an embodiment of the invention. Referring to the figure, a liquid chamber 3 is formed in an inner and lower portion of the device body 1 having a sealed container-like shape. The liquid chamber 3 has a role of temporarily storing a liquid Q which is supplied through an inflow port 2*a* and which is to be transported by a reciprocal pump. The transported liquid Q which is temporarily stored in the liquid chamber 3 is then transported to the outside through an outflow port 2*b*. *xxxx*

A gas chamber 4 is formed in an inner and upper portion of the device body 1. The gas chamber 4 is separted from the liquid chamber 3 by an extendable and contractible member, specifically, for example, a bellows 5. A portions 5*a* surrounded by the bellows 5 is used as a part of the liquid chamber 3. A cylindrical coupling member 6 is placed in a center portion of a closed end face 5*b* of the bellows 5. The cylindrical coupling member 6 protrudes in a direction along which the capacity of the liquid chamber 3 is increased, i.e., the extension direction of the bellows 5, and is pressed against the closed end face 5*b* by the elastic urging force of a spring 18.

An air supply and discharge switching valve mechanism 7 is mounted on the outer face of an upper wall 1*a* of the device body 1 which is positioned on the side of the gas chamber 4. In the air supply and discharge switching valve mechanism 7, a cylinder portion 9 is housed in a bottomed cylindrical casing 8. A slide valve element 10 is fitted into the cylinder portion 9 so as to be slidable in the axial direction (vertical direction) of the cylinder portion. A stem-like operating rod 11 is disposed so as to pass through a hole 1*b* formed in the upper wall 1*a* of the device body 1. The operating rod 11 is inserted into the gas chamber 4. An upper end portion of the operating rod 11 is coaxially coupled by a pin to a lower end portion of the slide valve element 10. A coupling flange 11*a* on the lower end side of the operating rod 11 is coupled to a reference position in the cylindrical coupling member 6.

The peripheral wall of the casing 8 has an air supply port 12 in a lower portion, and an air discharge port 13 in an upper portion. The air supply port 12 is used for supplying air of a pressure which is not lower than the maximum pressure of the transported liquid Q. The air discharge port 13 is opened in the atmosphere. In correspondence with the air supply port 12 and the air discharge port 13, ports 14 and 15 are formed in the peripheral wall of the cylinder portion 9, respectively. An air supply and discharge passage 16*a* is formed in the peripheral wall of the casing 8. The air supply and discharge passage 16*a* is a passage through which the gas chamber 4 communicates with the interior of the cylinder portion 9.

Three slide flanges 10*a*, 10*b*, and 10*c* are formed on the slide valve element 10 at predetermined spaces in the axial direction. The space between the center flange 10*b* and the lower flange 10*c* is formed as an air supply space S1, and the space between the center flange 10*b* and the upper flange 10*a* is formed as an air discharge space S2. In accordance with a change in the capacity of the liquid chamber 3 caused by variation of the discharge pressure of the reciprocal pump, the slide valve element 10 is alternately switched to a normal mode in which air is not supplied to nor discharged from the gas chamber 4, an air supply mode in which air is supplied to the gas chamber 4, and an air discharge mode in which air is discharged from the gas chamber 4. Specifically, when capacity of the gas chamber 4 is maintained within a predetermined range and the extension or contraction amount of the bellows 5 is within a predetermined range, the normal mode shown in FIG. 1 is maintained and the air supply and discharge passage 16*a* is isolated from the air supply space S1 and the air discharge space S2. When the capacity of the gas chamber 4 is increased by variation of the discharge pressure to exceed, the predetermined range and the bellows 5 tries to extend exceeding the predetermined range, the slide valve element 10 is raised so as to establish the air supply mode. In the air supply mode, the air supply port 12 communicates with the air supply and discharge passage 16*a* through the air supply space S1. When the capacity of the gas chamber 4 is decreased by variation of the discharge pressure to exceed the predetermined range and the bellows 5 tries to contract with, exceeding the predetermined range with the slide valve element 10 is lowered so as to establish the air discharge mode. In the air discharge mode, the air discharge port 13 communicates with the air supply and discharge passage 16*a* through the air discharge space S2.

In this embodiment, an extension and contraction restricting mechanism 51 is attached to the upper wall 1*a* of the device body 1. The extension and contraction restricting mechanism 51 has two cylindrical bodies 51A and 51B which are formed integrally with the upper wall 1*a* of the device body 1. The cylindrical bodies 51A and 51B have the same length and are arranged concentrically with the operating rod 11 so as to protrude into the gas chamber 4. The lower end portions of the cylindrical bodies 51A and 51B are formed as cylinder end faces 51*a* and 51*b* which are parallel to the closed end face 5*b* of the bellows 5. In the extension and contraction restricting mechanism 51, when the bellows 5 is caused to extend to a predetermined value by means of the cylindrical bodies 51A and 51B, the cylinder end faces 51*a* and 51*b* of the cylindrical bodies are contacted in parallel with the closed end face 5*b* of the bellows 5, thereby exhibiting an function of restricting further extension of the bellows 5. The number of cylindrical bodies is determined so that, when the bellows 5 is extendedly deformed to contact with the cylinder end faces, the closed end face 5*b* of the bellows 5 does not extend to exceed the predetermined value. The number is not restricted to two, and may be three or more.

Figure 2:
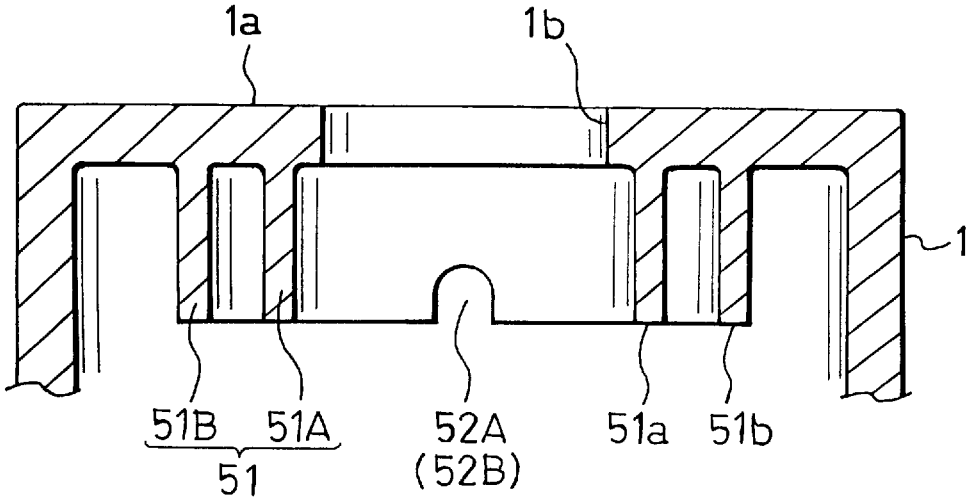
FIG. 2 is an enlarged longitudinal sectional side view of the main portions of the device of FIG. 1.
Figure 3:
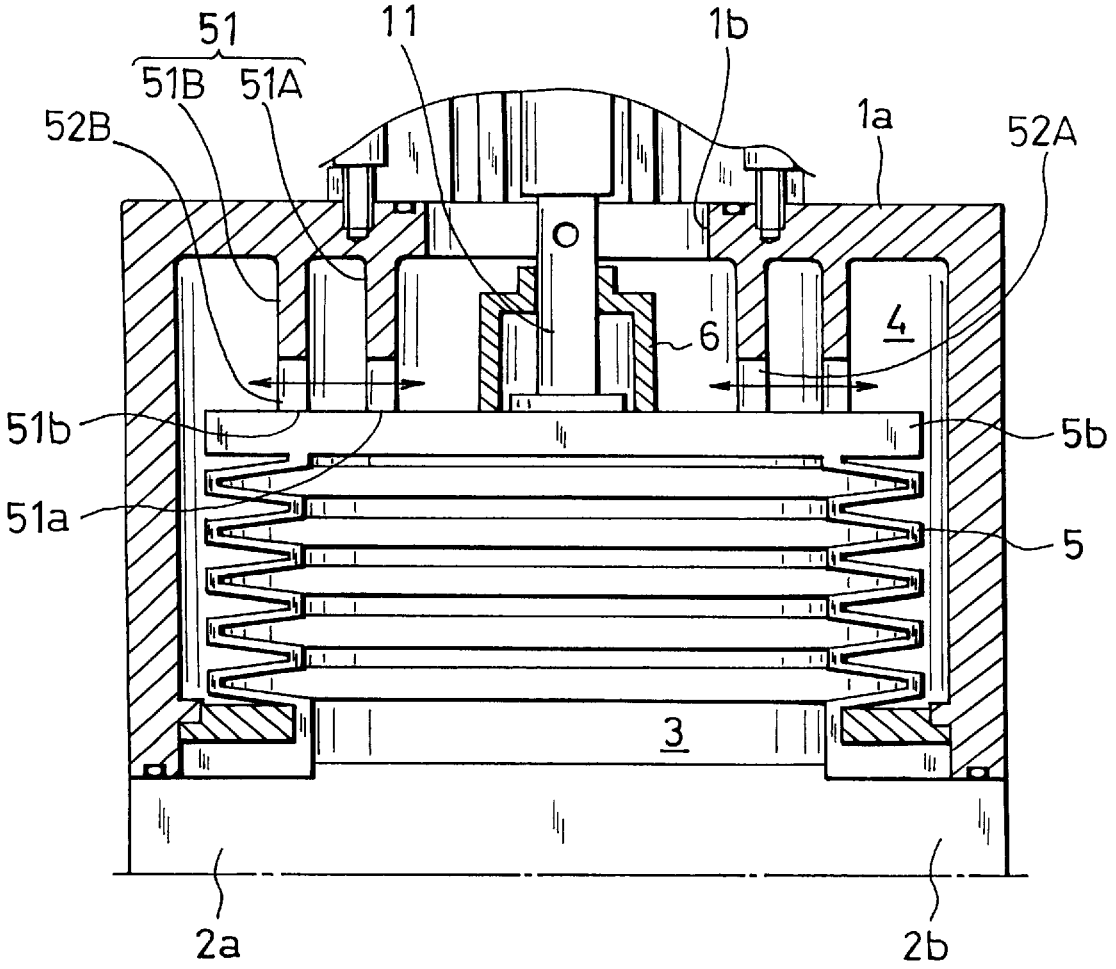
FIG. 3 is a longitudinal sectional front view of the main portions of the device of FIG. 1, showing an extension restricted state of a diaphragm.

As shown in FIG. 2, in the lower end portions of the peripheral walls of the cylindrical bodies 51A and 51B constituting the extension and contraction restricting mechanism 51, air flow holes 52A and 52B each configured by a notch having a size which does not impair the strength of the cylindrical body 51A or 51B are formed. The air flow holes 52A and 52B exert a function of, even when the bellows 5 extends to the predetermined value and the closed end face 5*b* is contacted with the cylinder end faces 51*a* and 51*b* in the lower ends of the cylindrical bodies 51A and 51B as shown in FIG. 3, causing the air in the gas chamber 4 to flow in the inward and outward directions as indicated by the arrows in the figure, whereby the pressure is maintained uniform over the whole range of the gas chamber 4. Each of the air flow holes 52A and 52B need not be configured as a notch, and instead may be configured by a through hole.

Next, the operation of the thus configured pulsation suppression device for a pump will be described.

When the reciprocal pump operates so as to transport the transported liquid Q toward a predetermined portion, the discharge pressure of the reciprocal pump generates pulsation corresponding to a discharge pressure curve in which peak and valley portions are repeated. The transported liquid Q which is supplied through the inflow port 2*a* is temporarily stored in the liquid chamber 3, and then flows out through the outflow port 2*b*. In the case where the air supply and discharge switching valve mechanism 7 is held in the normal mode, when the discharge pressure of the transported liquid Q comes to a peak portion of the discharge pressure curve, the transported liquid Q causes the bellows 5 to extend in the direction along which the capacity of the liquid chamber 3 is increased, and hence the pressure is absorbed. At this time, the flow quantity of the transported liquid Q flowing out from the liquid chamber 3 is smaller than that of the liquid supplied from the pump. By contrast, when the discharge pressure of the transported liquid Q comes to a valley portion of the discharge pressure curve, the pressure of the transported liquid Q becomes lower than the air pressure of the gas chamber 4 which is compressed by extension of the bellows 5, and hence the bellows 5 is contracted by the urging of the spring 18. At this time, the flow quantity of the transported liquid Q flowing from the pump into the liquid chamber 3 is larger than that of the liquid flowing out from the liquid chamber 3. This repeated operation, i.e., the capacity change of the liquid chamber 3 causes the pulsation to be absorbed and suppressed.

When the discharge pressure of the pump is varied in the increasing direction during such an operation, the quantity of the transported liquid Q is increased so as to increase the capacity of the liquid chamber 3, with the result that the bellows 5 largely extends. When the amount of extension of the bellows 5 exceeds the predetermined range, the slide valve element 10 is caused through the operating rod 11 to slide upward, and the air supply and discharge passage 16*a* communicates with the air supply port 12 through the air supply space S1, so that the air supply and discharge switching valve mechanism 7 is switched to the air supply mode. Therefore, higher air pressure is supplied from the air supply port 12 to the gas chamber 4 via the air supply space S1, the air supply and discharge passage 16*a*, the interior of a cylindrical member 19, and a flow hole 19*b*, thereby raising the air pressure of the gas chamber 4. According to this configuration, the extension amount of the bellows 5 is restricted, so that the capacity of the liquid chamber 3 is prevented from being excessively increased. As a result, even when the discharge pressure of the pump is varied, pulsation is efficiently absorbed and the amplitude of pulsation is suppressed to a low level.

By contrast, when the discharge pressure of the pump is varied in the decreasing direction, the quantity of the transported liquid Q is decreased so as to decrease the capacity of the liquid chamber 3, with the result that the bellows 5 is largely deformed so as to contract. When the amount of contraction of the bellows 5 exceeds the predetermined range, the slide valve element 10 is caused through the operating rod 11 to slide downward slide and the air supply and discharge passage 16*a* communicates with the air discharge port 13 through the air discharge space S2, so that the air supply and discharge switching valve mechanism 7 is switched to the air discharge mode. Therefore, the air a filled in the gas chamber 4 is discharged to the atmosphere from the air discharge port 13 via the flow hole 19*b*, the interior of the cylindrical member 19, the air supply and discharge passage 16*a*, and the air discharge space S2, thereby lowering the air pressure of the gas chamber 4. According to this configuration, the amount of contraction of the bellows 5 is restricted, so that the capacity of the liquid chamber 3 is prevented from being excessively decreased. As a result, even when the discharge pressure of the pump is varied, pulsation is efficiently absorbed and the amplitude of pulsation is suppressed to a low level.

In the pulsation suppression device, when the pressure of the liquid chamber 3 is raised and the bellows 5 extends to the predetermined value, for example, the closed end face 5*b* of the bellows 5 is contacted in parallel with the cylinder end faces 51*a* and 51*b* of the cylindrical bodies 51A and 51B of the extension and contraction restricting mechanism 51 as shown in FIG. 3, thereby restricting further extension of the bellows 5. Therefore, deformation and damage of the bellows 5, and those of the operating rod 11 which are due to the abutment between the bellows 5 and the lower end portion of the operating rod 11 are prevented from occurring. Consequently, the state where the operating rod 11 perpendicularly acts on the closed end face 5*b* of the bellows 5 is maintained. Even when the device is used for a long term, the expected air supplying and discharging action and pulsation suppression function are stably ensured, and a serious situation where the closed end face 5*b* of the bellows 5 is damaged and the transported liquid Q leaks to the outside can be prevented from occurring.

Even in a state where the bellows 5 extends to the predetermined value and the closed end face 5*b* is contacted with the cylinder end faces 51*a* and 51*b* as shown in FIG. 3, the air in the gas chamber 4 flows in the inward and outward directions through the air flow holes 52A and 52B formed in the cylindrical bodies 51A and 51B as indicated by the arrows in the figure, so that the pressure is maintained uniform over the whole range of the gas chamber 4 and the bellows 5 is not distorted.

Figure 4:
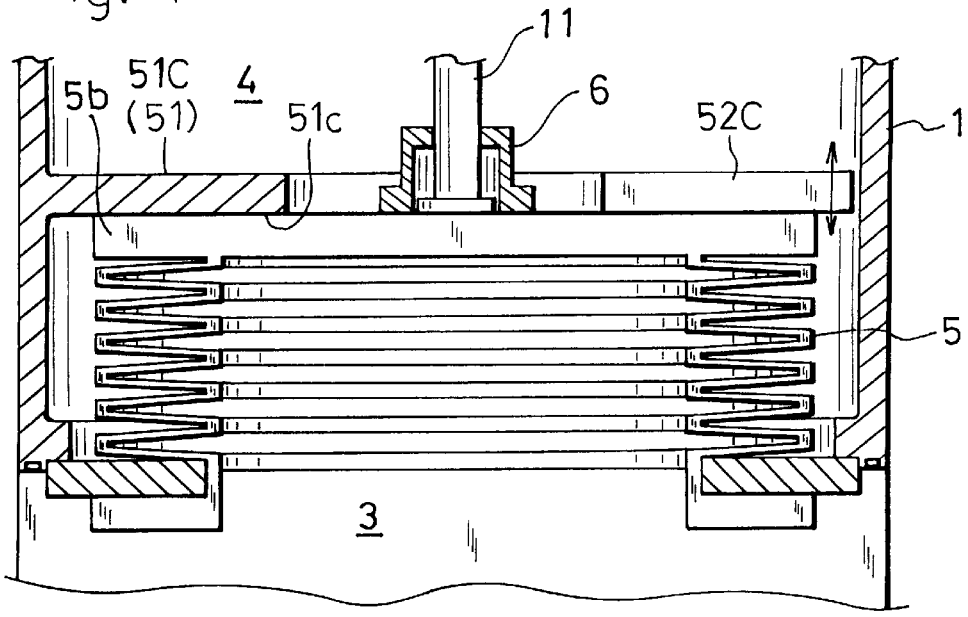
FIG. 4 is a longitudinal sectional front view of the main portions of a pulsation suppression device for a pump according to another embodiment of the present invention.
Figure 5:
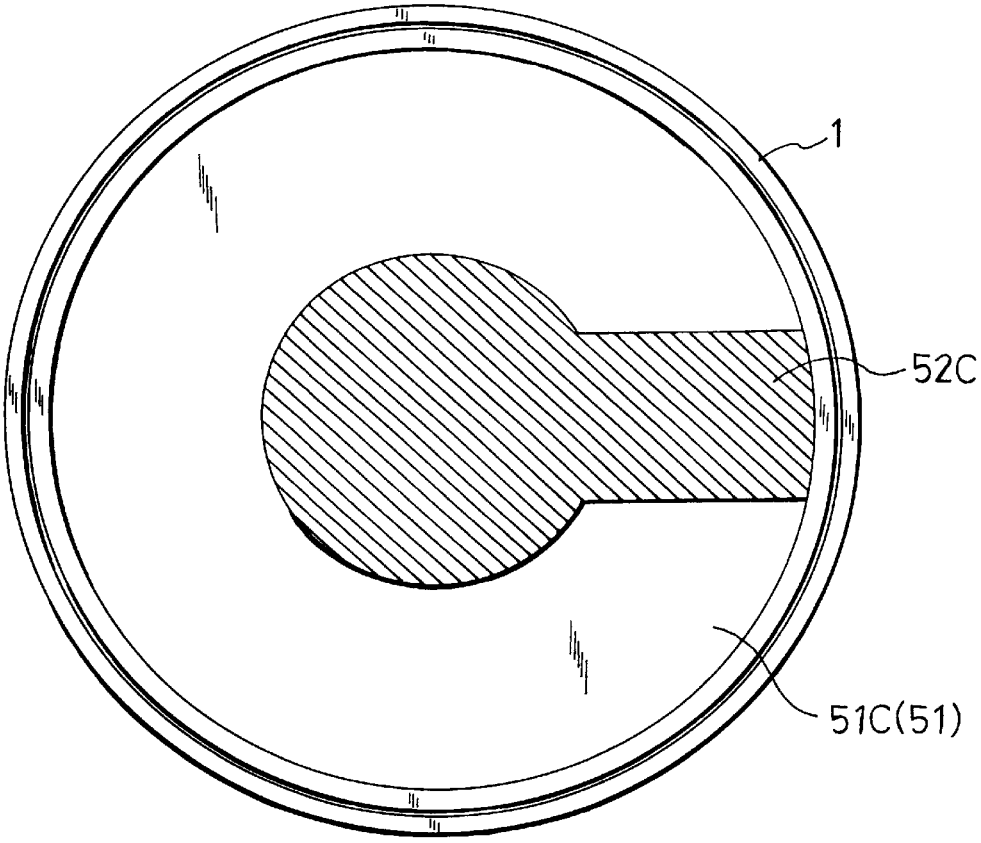
FIG. 5 is a plan view of the device of FIG. 4.

FIGS. 4 and 5 show another embodiment. In this embodiment, in place of the plural cylindrical bodies, a single annular plate 51C which is horizontally placed in a predetermined level position of the gas chamber 4 is used as the extension and contraction restricting mechanism 51 of the bellows 5. The annular plate 51C is integrally fixed to the inner peripheral face of the device body 1. When the bellows 5 extends to a predetermined value, the closed end face 5*b* of the bellows makes a parallel full face contact or substantially full face contact with the lower face 51*c* of the annular plate 51C, thereby restricting further extension of the bellows 5. Also in embodiment, in order to maintain the air pressure uniform over the whole range of the gas chamber 4 under the extension restricted state, an air flow hole 52C configured a notch or a through hole is formed in the annular plate 51C. The other configuration is identical with that of the embodiment which has been described with reference to FIGS. 1 to 3. Therefore, the corresponding portions are designated by the same reference numerals, and their detailed description is omitted.

Figure 6:
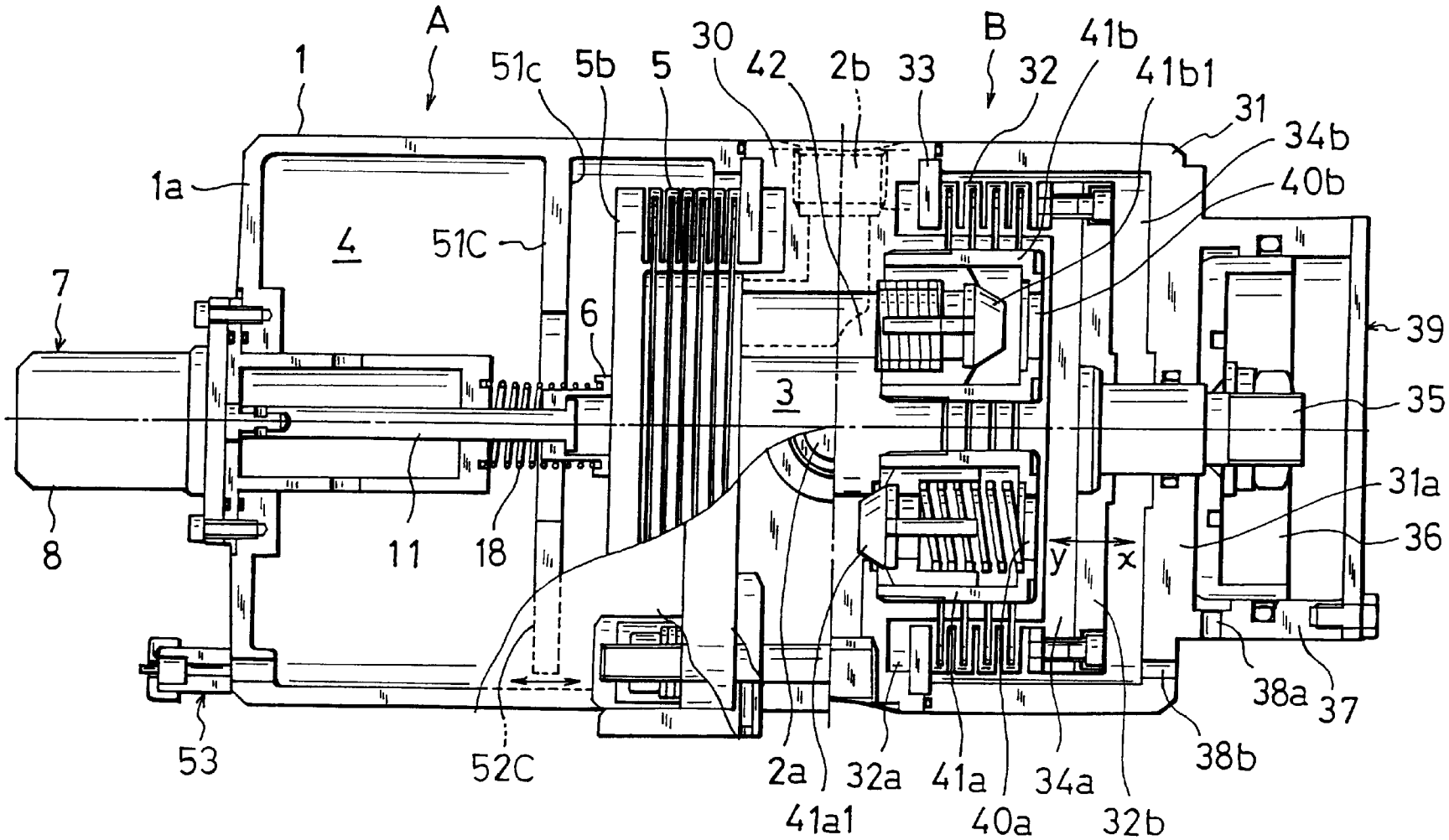
FIG. 6 is a longitudinal sectional front view of an assembled pulsation suppression device for an air driven bellows pump according to a further embodiment of the invention.

FIG. 6 shows a further embodiment of the invention.

This embodiment relates to a pulsation suppression device for an air driven bellows pump. In the air driven bellows pump, a pulsation suppression portion A which is configured in the same manner as the pulsation suppression portions of the embodiments described above is disposed in one side of a partition wall 30 having the inflow port 2*a* and the outflow port 2*b* for the transported liquid. A reciprocal pump portion B is integrally disposed on the other side of the partition wall 30. The pulsation suppression portion A is configured in the same manner as the pulsation suppression device shown in FIGS. 4 and 5. Therefore, the corresponding or equivalent portions are designated by the same reference numerals, and their detailed description is omitted. Hereinafter, the configuration of the reciprocal pump portion B will be described.

A bottomed cylindrical casing 31 is fixedly continuously disposed on the partition wall 30. A bellows 32 serving as a pump working member which is extendable and contractible in the axial direction of the cylinder is disposed in the bottomed cylindrical casing 31. An opening peripheral edge 32*a* of the bellows 32 is airtightly pressingly fixed to the partition wall 30 by an annular fixing plate 33. According to this configuration, the inner space of the casing 31 is hermetically partitioned into a pump working chamber 34*a* inside this bellows 32, and a pump operating chamber 34*b* outside the bellows 32. A cylinder body 37 is fixed via a coupling member 35 to the outside of a bottom wall portion 31*a* of the bottomed cylindrical casing 31. In the cylinder body 37, a piston body 36 which is fixedly coupled to a closed end member 32*b* of the bellows 32 is slidably housed. Pressurized air which is fed from a pressurized air supplying device (not shown) such as a compressor is supplied to the interior of the cylinder body 37, or the pump operating chamber 34*b* via air holes 38*a* and 38*b* formed in the cylinder body 37 and the bottom wall portion 31*a* of the casing 31, thereby configuring an air cylinder portion 39 which drives the bellows 32 so as to be deformed by extension and contraction.

A suction port 40*a* and a discharge port 40*b* which are opened in the pump working chamber 34*a* communicate with the inflow port 2*a* and the outflow port 2*b*, respectively. A suction check valve 41*a* having a movable valve element 41*a*1, and a discharge check valve 41*b* having a movable valve element 41*b*1 are disposed in the suction port 40*a* and the discharge port 40*b*, respectively. The check valves are alternately opened and closed in accordance with extension and contraction of the bellows 32. The above-mentioned components constitute the reciprocal pump portion B.

In the thus configured air driven bellows pump, when the pressurized air which is fed from the pressurized air supplying device (not shown) such as a compressor is supplied to the interior of the cylinder body 37 of the air cylinder portion 39 so as to extend the bellows 32 in the x direction of FIG. 6, the transported liquid in the inflow port 2*a* is sucked into the pump working chamber 34*a* through the suction check valve 41*a*. When the pressurized air is then supplied into the pump operating chamber 34*b* of the air cylinder portion 39 so as to contract the bellows 32 in the y direction of FIG. 6, the transported liquid which has been sucked into the pump operating chamber 34*b* is discharged via the discharge check valve 41*b*. In this way, when the bellows 32 of the reciprocal pump portion B is driven via the air cylinder portion 39 so as to be extendedly and contractedly deformed, the suction check valve 41*a* and the discharge check valve 41*b* are alternately opened and closed, so that suction of the liquid from the inflow port 2*a* into the pump working chamber 34*a*, and discharge of the liquid from the pump working chamber 34*a* to the outflow port 2*b* are repeated to conduct a predetermined pumping action. The transported liquid which is discharged from the pump working chamber 34*a* via the discharge check valve 41*b* in accordance with the operation of the reciprocal pump portion B is sent into the liquid chamber 3 in the pulsation suppression portion A through a communication passage 42 formed in the partition wall 30, to be temporarily stored in the liquid chamber 3, and then flows out to the outflow port 2*b*. At this time, the pump discharge pressure generates pulsation due to repetition of peak and valley portions. In the same manner as the embodiments described above, the pulsation is absorbed and suppressed by a change in the capacity of the liquid chamber 3.

In the thus configured air driven bellows pump, the pulsation suppression function and the function of restricting extension of the bellows 5 with respect to variation of the discharge pressure from the reciprocal pump portion B can be attained in the same manner as those which have been described with reference to FIG. 4 and the like.

The air driven bellows pump of FIG. 6 is usually used as a horizontal type in order to extend and contract the bellows 5 and 32 in a horizontal direction. Therefore, a liquid leakage detection sensor 53 is disposed in a bottom position of the gas chamber 4 in the pulsation suppression portion A. According to this configuration, when liquid leakage from the liquid chamber 3 to the gas chamber 4 is caused by any chance by breakage of the bellows 5 or the like, the sensor 53 promptly detects the liquid leakage. When the liquid leakage is known, it is possible to prevent the leakage from developing into a serious situation such as a leakage to the outside of the device body 1.

Figure 7:
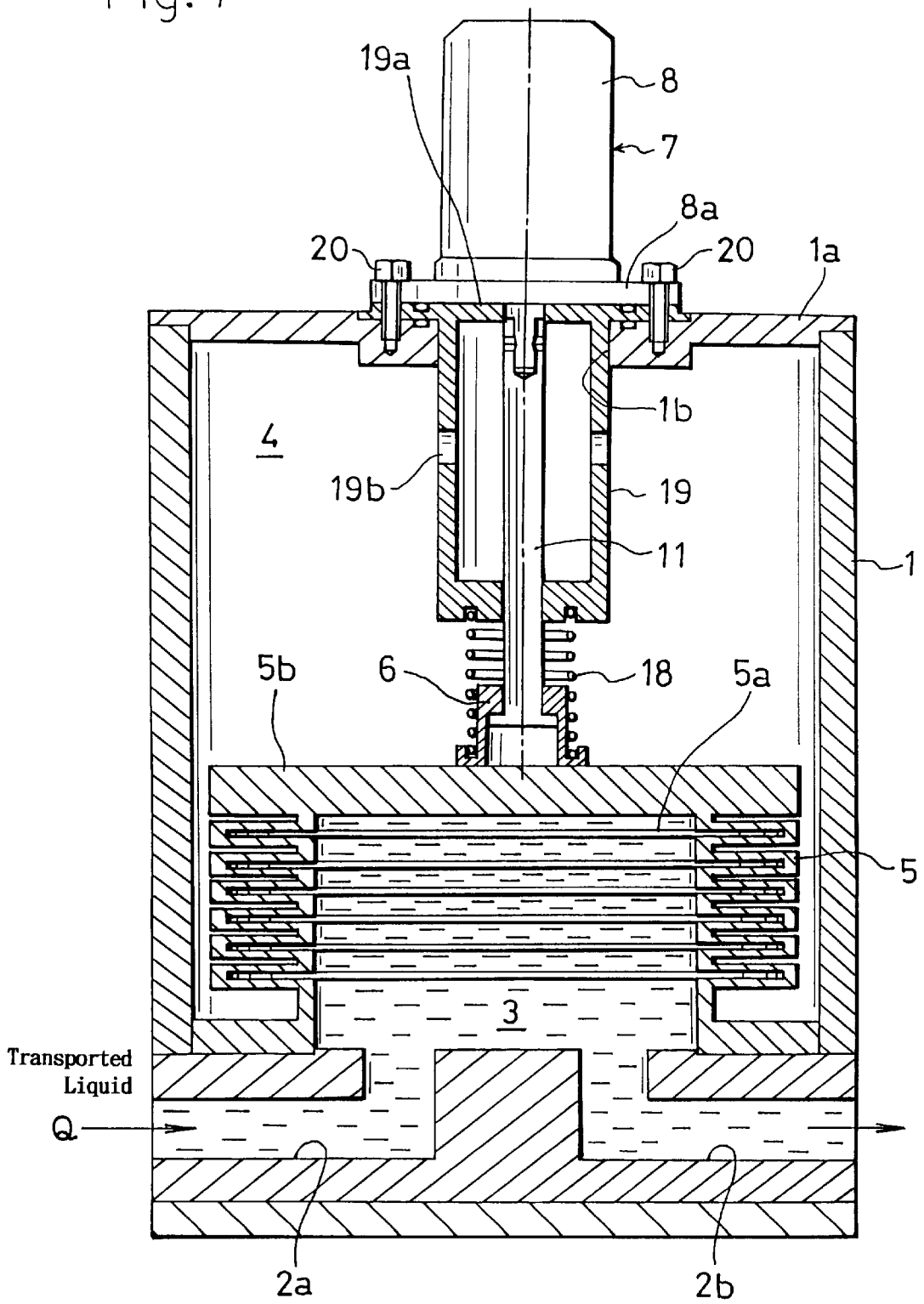
FIG. 7 is a longitudinal sectional front view of an assembled pulsation suppression device for a pump according to a still further embodiment of the present invention.
Figure 8:
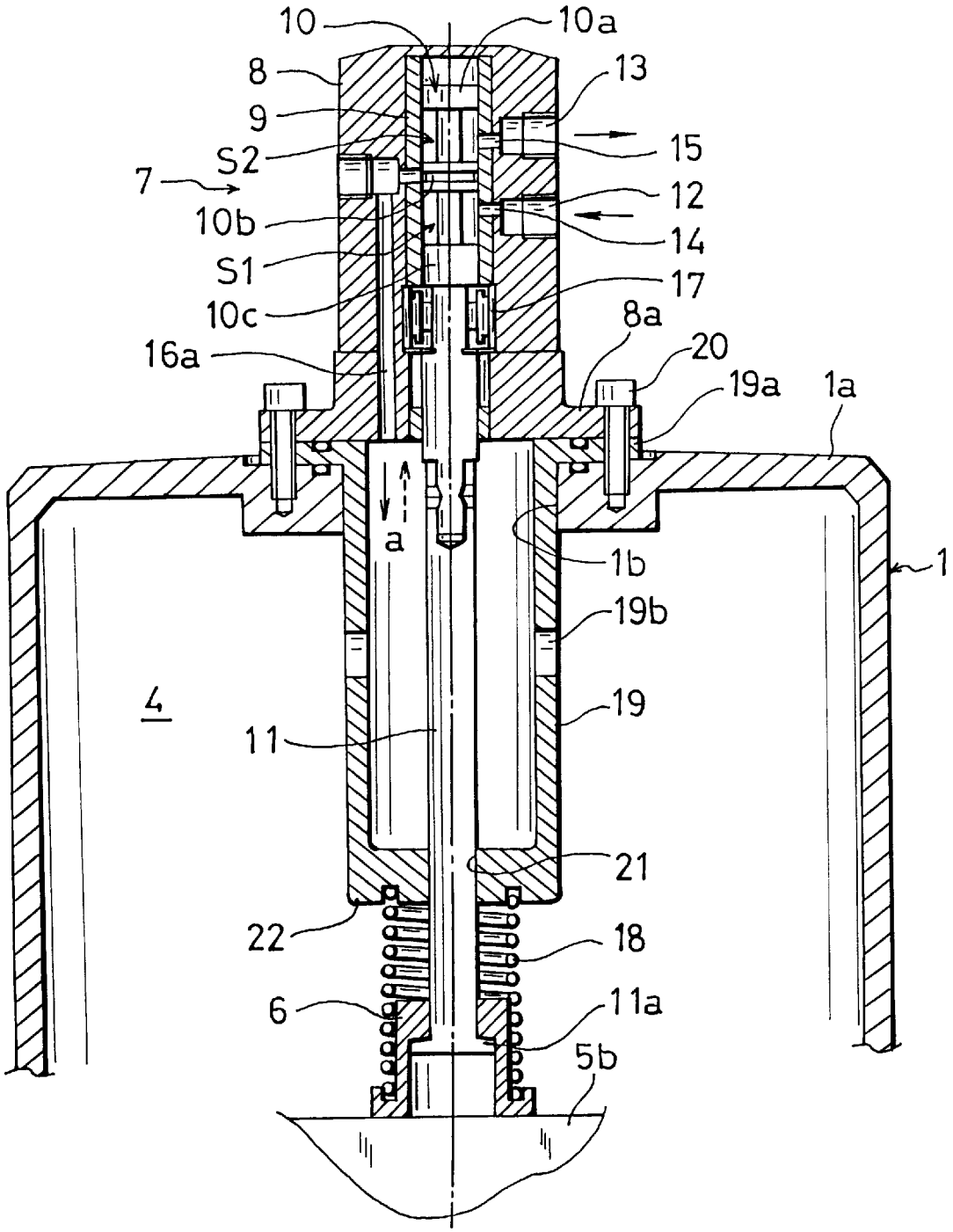
FIG. 8 is an enlarged longitudinal sectional front view of main portions of the device of FIG. 7.
Figure 9:
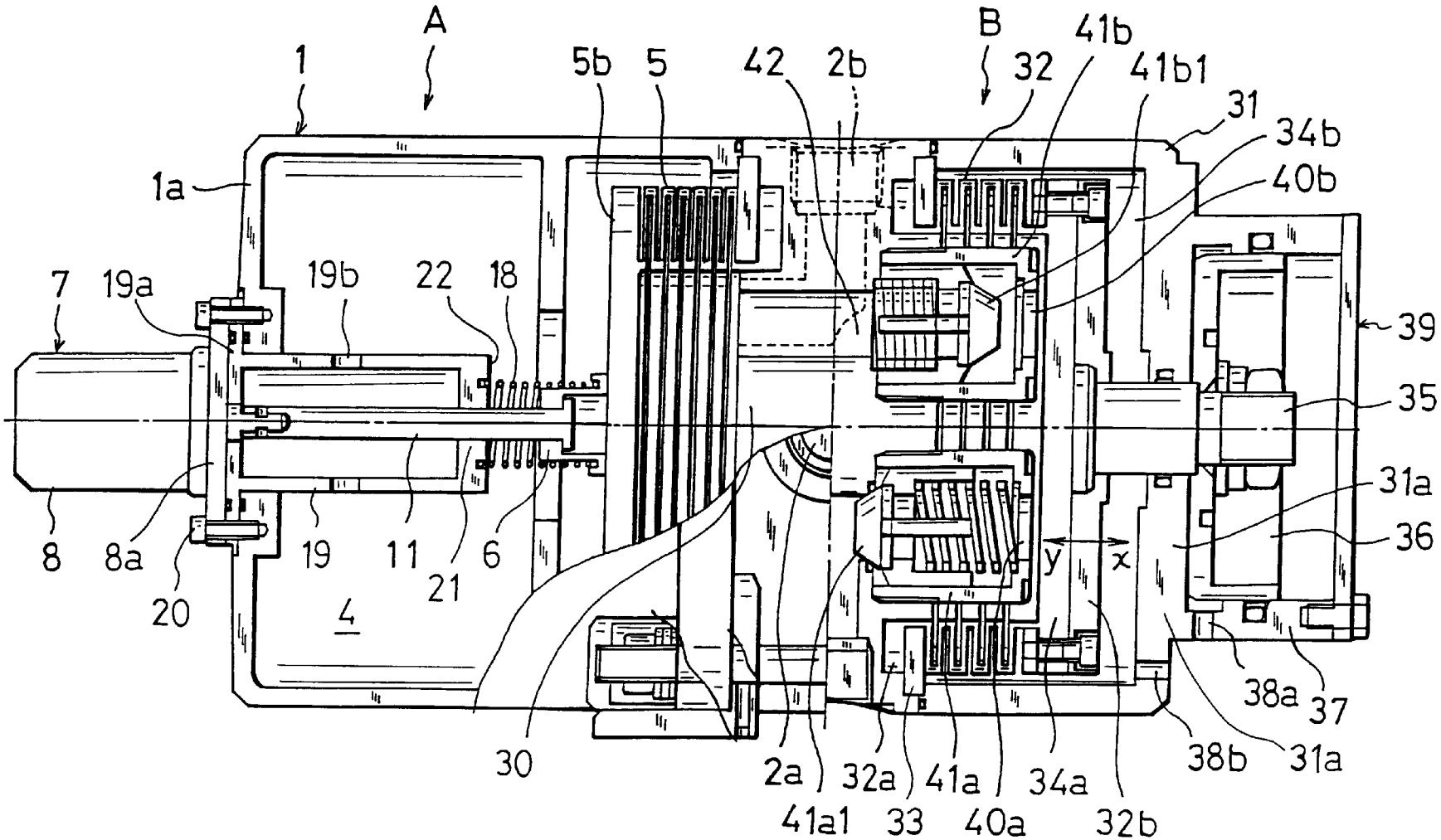
FIG. 9 is a longitudinal sectional front view of an assembled pulsation suppression device for an air driven bellows pump according to a still further embodiment of the present invention.

Next, an embodiment of a further embodiment of the invention will be described with reference to FIGS. 7 to 9.

Most of the pulsation suppression device is configured in the same manner as the device which has been described with reference to FIG. 1. Therefore, the portions corresponding to those shown in FIG. 1 are designated by the same reference numerals, and their detailed description is omitted. Hereinafter, the description will be made mainly on different portions.

In the embodiment, the cylindrical member 19 is disposed in the gas chamber 4 of the device body 1 so as to protrude downward from the upper portion. The cylindrical member 19 has a flange 19*a* in the upper end portion. A lower end flange 8*a* of the bottomed cylindrical casing 8 of the air supply and discharge switching valve mechanism 7 is opposed to the flange 19*a*. The flanges 8*a* and 19*a* under the opposed state are fixed to the upper wall 1*a* of the device body 1 by common bolts 20. The opening of the air supply and discharge passage 16*a* is positioned inside the upper end opening of the cylindrical member 19 which is fixed to the upper wall 1*a* of the device body 1 in this way. The cylindrical member 19 is made of a low-friction resin material which is selected from the group consisting of PP, PVC, PE, POM, PA, PC, PTFE, ETFE, PVDF, and PFA. A guide 21 which slidingly guides the operation in the axial direction (vertical direction) of the operating rod 11 is formed in a projection end portion, i.e., the lower end portion of the cylindrical member 19. The flow hole 19*b* having a size that does not impede an air flow with respect to the gas chamber 4 is formed in a substantially middle portion in the axial direction of the peripheral wall of the cylindrical member 19. The lower face of the guide 21 is formed as a flat seat 22 which engagingly holds the upper end portion of the spring 18 which is interposed between the guide and the cylindrical coupling member 6. Therefore, the spring 18 always exerts the function of elastically urging the bellows 5 in the direction of reducing the capacity of the liquid chamber 3. In the figures, 17 denotes a spring member which is disposed in the casing 8, and which has a role of applying an upward spring force to the slide valve element 10 to hold the slide valve element 10 to the reference position.

Next, the operation of the thus configured pulsation suppression device for a pump will be described. In the pulsation suppression device, pulsation is suppressed by switching the mode of the air supply and discharge switching valve mechanism 7, in the same manner as the device which has been described with reference to FIG. 1.

In the pulsation suppression device, the axial reciprocal operation of the operating rod 11 which reciprocally operates in the axial direction in accordance with extension and contraction of the bellows 5 is slidingly guided by the guide 21. Even when, in order to enhance the pulsation suppression function, the gas chamber 4 is elongated in the extension and contraction directions of the bellows 5 so as to increase the internal capacity of the gas chamber 4, and the axial length of the operating rod 11 is elongated, therefore, the operating rod 11 which reciprocally operates is prevented from being inclined, and the spring 18 which urges the bellows 5 is prevented from being deformed. Consequently, the operating rod 11 perpendicularly acts on the bellows 5. At the same time, the reliability of the mode switching, i.e., the operation reliability of the air supply and discharge switching valve mechanism 7 which is interlocked with displacement of the bellows 5 is enhanced.

Since the upper end portion of the spring 18 which urges the bellows 5 is engagingly held by the flat seat 22 of the lower face of the guide 21, the necessary length of the spring 18 can be suppressed to a short one, and hence it is easy to prevent the spring 18 from being deformed.

Since the cylindrical member 19 constituting the guide 21 is made of a low-friction resin material which is selected from the group consisting of PP, PVC, PE, POM, PA, PC, PTFE, ETFE, PVDF, and PFA, the friction resistance in the reciprocal operation of the operating rod 11 can be reduced without using a special guiding device such as a bearing so that the expected pulsation suppression function is stably conducted.

A still further embodiment of the present invention will be described with reference to FIG. 9. This embodiment relates to a pulsation suppression device for an air driven bellows pump. In the air driven bellows pump, a pulsation suppression portion A which is configured in the same manner as the pulsation suppression portion which has been described with reference to FIGS. 7 and 8 is disposed on one side of the partition wall 30 having the inflow port 2*a* and the outflow port 2*b* for the transported liquid Q, and the reciprocal pump portion B is integrally disposed on the other side of the partition wall 30. The reciprocal pump portion B is configured in the same manner as the pump which has been described with reference to FIG. 6. Therefore, the corresponding or equivalent portions are designated by the same reference numerals, and their detailed description is omitted.

In the thus configured air driven bellows pump, the pulsation suppression function with respect to variation of the discharge pressure from the reciprocal pump portion B can be attained in the same manner as that of the embodiments which have been described above. The air driven bellows pump is usually used as a horizontal type in which the axial direction of the operating rod 11 elongates along a horizontal plane. When the operating rod 11 is long, therefore, the operating rod tends to be inclined by its gravity and the like. Even in such a horizontal type, the employment of the configuration in which the long operating rod 11 is slidingly guided by the guide 21 enables the effect of normalizing the air supplying and discharging action to be remarkably exerted.

When, as in the case of the above-described embodiment, a cylindrical member is used as the cylindrical member 19 constituting the guide 21 and the flow hole 19*b* is formed in the peripheral wall, the capacities (particularly, radial dimensions) of the guide 21 and the cylindrical member 19 to be occupied in the gas chamber 4 can be made a minimum so that the assembled device can be easily reduced in size. At the same time, there is an advantage that, even when the cylindrical member 19 is disposed in the gas chamber 4, the gas supplying and discharging action on the gas chamber 4 can be smoothly conducted without causing hindrance. Even in a configuration in which a polygonal cylindrical member is used and the flow hole 19*b* is formed in the peripheral wall of the polygonal cylindrical member, the normalization of the air supplying and discharging action during the pulsation suppression can be ensured.

As described in the embodiment above, the lower end flange 8*a* of the bottomed cylindrical casing 8 of the air supply and discharge switching valve mechanism 7, and the upper end flange 19*a* of the cylindrical member 19 constituting the guide 21 are fixed under the opposed state to the upper wall 1*a* of the device body 1 by the common bolts 20. The employment of this configuration enables the operating rod 11 to be previously passed through the cylindrical member 19 via the cylindrical coupling member 6 and the spring 18 and then coupled to the slide valve element 10, and the coupled structure to, as an integral member, be fixed to or unfixed from the upper wall 1*a* of the device body 1. According to this configuration, therefore, maintenance including the assembly and repair of the whole device and replacement of a part can be facilitated.

What is claimed is:

1. A pulsation suppression device for a pump, comprising:

a device body having a sealed container-like shape;

a diaphragm which partitions an interior of said device body into a liquid chamber that can temporarily store a liquid to be transported by a reciprocal pump, and a gas chamber that is to be filled with a gas for suppressing pulsation, and which extends and contracts to change a capacity of said liquid chamber, thereby absorbing pulsation due to a discharge pressure of the transported liquid;

a gas supply and discharge switching valve mechanism which is attached to an outside of said device body, and which, in accordance with a change in the capacity of said liquid chamber, is alternately switched to a normal mode in which the gas is not supplied to nor discharged from said gas chamber, a gas supply mode in which the gas is supplied to said gas chamber, and a gas discharge mode in which the gas is discharged from said gas chamber; and an operating rod which is reciprocated in interlock relationship with extension and contraction of said diaphragm, and which switches over the modes of said switching valve mechanism by means of the reciprocal operation, wherein said device further comprises an extension and contraction restricting mechanism which is disposed in said gas chamber, and which is contacted with a closed end face of said diaphragm that extends to a predetermined value, thereby restricting further extension of said diaphragm.

2. A pulsation suppression device for a pump according to claim 1, wherein said extension and contraction restricting mechanism has a cylindrical end face which is contacted in parallel with said closed end face of said diaphragm.

3. A pulsation suppression device for a pump according to claim 2, wherein said extension and contraction restricting mechanism is formed by plural cylindrical end faces which are configured by end faces of plural cylindrical bodies that are concentrically arranged in said gas chamber.

4. A pulsation suppression device for a pump according to claim 3, wherein each of said plural cylindrical bodies has a flow hole having a size which does not impede a flow of the gas.

5. A pulsation suppression device for a pump according to claim 1, wherein said extension and contraction restricting mechanism is formed by a single annular plate which is fixedly disposed in said gas chamber.

6. A pulsation suppression device for a pump according to claim 5, wherein a lower face of said annular plate is contacted in parallel with the closed end face of said diaphragm.

7. A pulsation suppression device for a pump according to claim 5, wherein said annular plate has a flow hole having a size which does not impede a flow of the gas.

8. A pulsation suppression device for a pump according to claim 1, wherein said device body is configured as a horizontal type in which said diaphragm extends and contracts in a horizontal direction, and a liquid leakage detection sensor is disposed in a position of a bottom portion of said gas chamber.

9. A pulsation suppression device for a pump, comprising:

a device body having a sealed container-like shape;

a diaphragm which partitions an interior of said device body into a liquid chamber that can temporarily store a liquid to be transported by a reciprocal pump, and a gas chamber that is to be filled with a gas for suppressing pulsation, and which extends and contracts to change a capacity of said liquid chamber, thereby absorbing pulsation due to a discharge pressure of the transported liquid;

a gas supply and discharge switching valve mechanism which is attached to an outside of said device body, and which, in accordance with a change in the capacity of said liquid chamber, is alternately switched to a normal mode in which the gas is not supplied to nor discharged from said gas chamber, a gas supply mode in which the gas is supplied to said gas chamber, and a gas discharge mode in which the gas is discharged from said gas chamber; and an operating rod which is reciprocated in interlock relationship with extension and contraction of said diaphragm, and which switches over the modes of said switching valve mechanism by means of the reciprocal operation, wherein said device further comprises a guide which allows said operating rod to slide and which guides the reciprocal operation of said operating rod in the extension and contraction directions of said diaphragm, and said guide is formed in a projection end portion of a cylindrical member which is protrudingly disposed in said gas chamber, and a flow hole having a size that does not impede a flow of the gas is formed in said cylindrical member.

10. A pulsation suppression device for a pump according to claim 9, wherein said device further comprises a spring which pressingly urges said diaphram in a direction along which the capacity of said liquid chamber is reduced.

11. A pulsation suppression device for a pump according to claim 10, wherein said guide has a flat seat which holds one end of said spring.

12. A pulsation suppression device for a pump according to claim 9, wherein said guide is made of a material which is selected from the group consisting of PP, PVC, PE, POM, PA, PC, PTFE, ETFE, PVDF, and PFA.

* * * * *

UNITED STATES PATENT AND TRADEMARK OFFICE

CERTIFICATE OF CORRECTION

PATENT NO. : 6,095,194
DATED : August 1, 2000
INVENTOR(S) : Yoji Minato et al.

It is certified that error appears in the above-identified patent and that said Letters Patent is hereby corrected as shown below:

Column 16, claim 10,
Line 13, "diaphram" should be -- diaphragm --.

Signed and Sealed this

Twenty-second Day of January, 2002

*Attest:*

*Attesting Officer*

JAMES E. ROGAN
*Director of the United States Patent and Trademark Office*